United States Patent [19]

Rocca

[11] 4,201,807

[45] May 6, 1980

[54] ACCESSORY ITEM

[76] Inventor: Anthony A. Rocca, 612 N. Michigan Ave., Chicago, Ill. 60611

[21] Appl. No.: 923,590

[22] Filed: Jul. 11, 1978

[51] Int. Cl.[2] ..... A45C 1/12

[52] U.S. Cl. ..... 428/35; D9/55; D19/67; D19/97; D21/114; 229/8.5; 229/22; 428/43; 428/136; 428/542

[58] Field of Search ..... D34/11 A, 11 R; 46/12, 46/19, 21; 206/45.34, 390, 409; 229/8.5, 22; 428/7, 8, 9, 12, 542, 35, 43, 116, 155, 156; D9/54, 55; D21/114; D19/67, 69, 97

[56] References Cited

U.S. PATENT DOCUMENTS

| | | | |
|---|---|---|---|
| D. 13,144 | 8/1882 | Yser et al. | D34/11 |
| 490,680 | 1/1893 | Roberts | 229/22 |
| 781,082 | 1/1905 | Morris | 229/22 |
| 1,531,789 | 3/1925 | Jennings et al. | 427/276 |
| 1,569,066 | 1/1926 | Beiger | 46/19 |
| 2,216,915 | 10/1940 | Johnson | 428/542 X |
| 2,344,639 | 3/1944 | Ressinger | 428/7 X |
| 2,727,622 | 12/1955 | Neumann | 428/7 X |
| 2,847,118 | 8/1958 | Johnson | D19/69 X |
| 2,935,238 | 5/1960 | Koehler | 428/542 X |
| 3,611,617 | 10/1971 | Foster et al. | 428/542 X |
| 3,812,002 | 5/1974 | Lurie | 428/43 |

*Primary Examiner*—Henry F. Epstein

*Attorney, Agent, or Firm*—Leydig, Voit, Osann, Mayer & Holt

[57] ABSTRACT

A multi-purpose accessory item comprises a hollow superstructure which is removably mounted on a base. The superstructure has one area of reduced cross-sectional thickness formed on its interior surface which can be easily removed to create an opening in the superstructure. In one embodiment, the superstructure is shaped as a stone or brick pyramid and the area of reduced thickness coincides with the simulated mortar between the stone or brick.

1 Claim, 6 Drawing Figures

ACCESSORY ITEM

BACKGROUND OF THE INVENTION

This invention relates to an accessory item and more particularly to a multi-purpose accessory item which may be adapted to serve several purposes.

An object of this invention is to provide a new and improved accessory item. A more particular object is to provide an accessory item that is capable of serving several purposes. A further object of the invention is to provide an inexpensive and useful multi-purpose accessory item that presents an aesthetically pleasing appearance.

In the preferred embodiment of my invention, a hollow superstructure is removably mounted on a base. The superstructure has one area of reduced cross-sectional thickness formed in its interior surface which can be easily removed to create an opening in the superstructure. The opening may serve many functions, such as a coin slot for a bank, a stamp dispensing slot, or the like.

DETAILED DESCRIPTION OF THE INVENTION

FIGS. 1 to 6 show the present invention comprising a hollow superstructure 4 removably mounted on the base 12. The accessory item can serve, among other things, as a stamp dispenser or coin bank. In the preferred embodiment, the superstructure 4 is shaped as a pyramid, which is depicted as being made of stone or brick.

Figure 1:
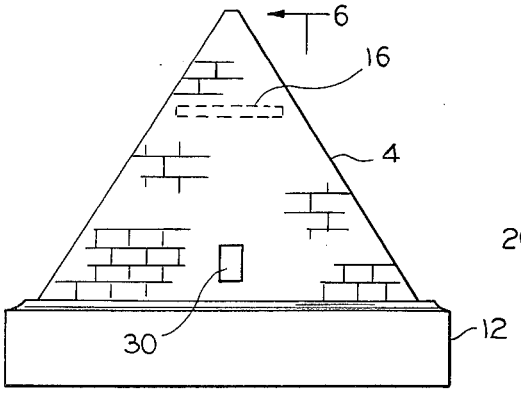
FIG. 1 is a side-elevational view of the inventive accessory item.
Figure 4:
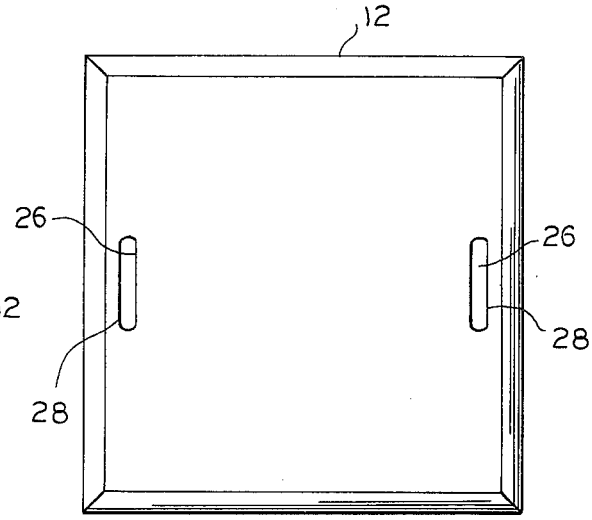
FIG. 4 is a plan view of the base.
Figure 2:
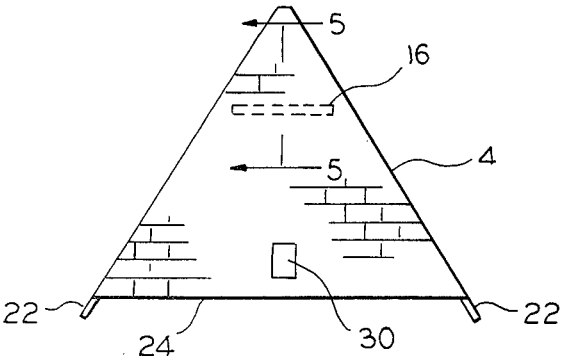
FIG. 2 is a side-elevational view of the superstructure according to this invention.
Figure 5:
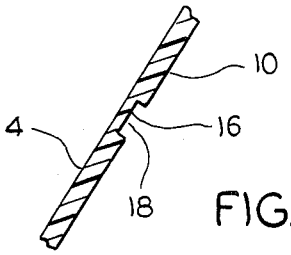
FIG. 5 is a cross-sectional view of a fragment of the superstructure wall taken along line 5—5 of FIG. 2.
Figure 3:
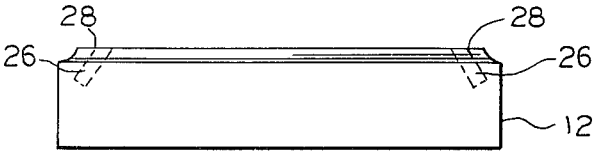
FIG. 3 is a side-elevational view of the base.
Figure 6:
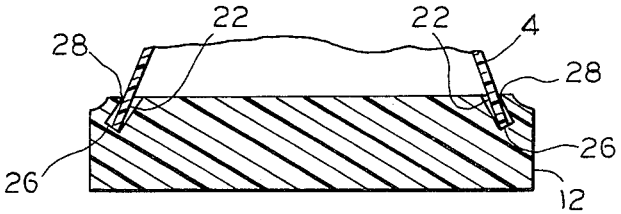
FIG. 6 is a partial cross-sectional view of the inventive accessory item taken along line 6—6 of FIG. 1.

Area 16 of reduced cross-sectional thickness, which can be easily removed to create an opening, is formed in the interior surface 10 of the superstructure 4 by a recess 18 (FIG. 5).

Preferably, area 16 may be made to coincide with the lines of mortar formed between the stones or bricks. In this way, the hole which is created in the side wall may be coordinated with the door 30.

Superstructure 4 is removably mounted on the base 12 by means of at least two fastener tabs 22 extending downwardly from the bottom edge 24 of superstructure 4 and insert slots 26 in the base 12 which are located and shaped to receive tabs 22. Preferably, fastener tabs 22 extend from the bottom edge 24 at an angle with the vertical plane. Insert slots 26 are positioned at an angle with the vertical plane slightly greater than the angle of tabs 22. For example, the angle of tabs 22 may be 38° from the vertical plane and the angle of insert slots 26 may be 42° from the vertical plane. Because the vertical angle of slots 26 is greater than that of tabs 22, tabs 22 will be urged against the interior surfaces of slots 26 when inserted, thereby creating a tight connection at edge 28 of insert slots 26.

The superstructure 4 can be easily removed from the base 12 by gently pressing the bottom edge 24 of the wall inwardly to relieve the pressure exerted by tabs 12 against the interior surfaces of insert slots 26. Thus, a secure connection for superstructure 4 and base 12 is provided, which enables the superstructure 4 to be easily installed or removed from base 12 when desired.

To use the multi-purpose accessory item, superstructure 4 may be removed from base 12. An opening may then be created by removing area 16 of reduced thickness. After the opening is formed, superstructure 4 is replaced on base 12. The accessory item can now be adapted to serve, among other things, as a coin bank or stamp dispenser.

The present invention provides a convenient and easily manufactured accessory item that is capable of serving many different purposes.

It is understood that the foregoing disclosure is given by way of illustrative example only, rather than by way of limitation, and the details may be varied within the scope of the appended claims.

I claim:

1. An accessory item comprising: a base; a hollow pyramidal shaped superstructure removably mounted on said base having an elongated area of reduced cross-sectional thickness formed in one interior planar wall surface of said pyramidal superstructure and defining an elongated recess in said interior planar wall surface, whereby said area of reduced cross-sectional thickness can be easily removed to form an elongated slot-like opening in one wall of said pyramidal superstructure; at least two tabs extending downwardly from the bottom edge of said pyramidal superstructure with at least one of said tabs being formed on and extending from the bottom edge of each of two opposed planar walls of said pyramidal superstructure with said tabs lying in the planes of said planar walls so as to be disposed at an angle with the vertical plane; and at least two slots disposed in said base shaped to receive said tabs, said slots being positioned at an angle with said vertical plane slightly greater than the angle of said tabs, whereby said tabs are urged against the interior of said slots in said base when inserted to provide a secure connection between said superstructure and said base, and whereby said bottom edge of at least one of said two opposed planar walls of said pyramidal superstructure is free to be pressed inwardly relative to the plane thereof so as relieve the pressure exerted by said tab on said inwardly pressed wall against said interior surface of one of said slots so as to permit removal of said pyramidal superstructure from said base.

* * * * *